US009894716B2

(12) United States Patent
Mohr

(10) Patent No.: US 9,894,716 B2
(45) Date of Patent: Feb. 13, 2018

(54) HEATING DEVICE AND METHOD FOR OPERATING A HEATING DEVICE

(71) Applicant: E.G.O. Elektro-Geraetebau GmbH, Oberderdingen (DE)

(72) Inventor: Hans Mohr, Sulzfeld (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 609 days.

(21) Appl. No.: 14/455,164

(22) Filed: Aug. 8, 2014

(65) Prior Publication Data

US 2015/0048076 A1 Feb. 19, 2015

(30) Foreign Application Priority Data

Aug. 16, 2013 (DE) ..... 10 2013 216 290

(51) Int. Cl.
*H05B 3/68* (2006.01)
*H05B 3/74* (2006.01)
(Continued)

(52) U.S. Cl.
CPC ..... *H05B 3/746* (2013.01); *H05B 1/0216* (2013.01); *H05B 1/0266* (2013.01); *H05B 3/76* (2013.01); *H05B 2213/04* (2013.01)

(58) Field of Classification Search
CPC ..... H05B 3/748; H05B 3/746; H05B 3/54; H05B 3/44; H05B 3/03; H05B 3/68; H05B 1/0216; H05B 1/0261; H05B 1/0263; H05B 1/0266; H05B 1/0258; H05B 2213/04; H05B 2213/07; A47J 27/004; A47J 37/0629
See application file for complete search history.

(56) References Cited

U.S. PATENT DOCUMENTS

RE31,596 E 6/1984 Kicherer et al.
4,511,789 A 4/1985 Goessler et al.
(Continued)

FOREIGN PATENT DOCUMENTS

DE 3314501 A1 10/1984
DE 102008014805 A1 3/2009
(Continued)

OTHER PUBLICATIONS

European Patent Office, Extended Search Report for Application No. 14179435.4, dated Jan. 29, 2015, 6 pages, Germany.

*Primary Examiner* — Shawntina Fuqua
(74) *Attorney, Agent, or Firm* — Alston & Bird LLP

(57) ABSTRACT

A heating device for a cooking point in a hob has three independent and separate long heating elements which are arranged on a support of the heating device along concentric circles. The support has a central region around the center point, an outer region adjoining an outer edge, and an intermediate region between the central region and outer region. A rod-type thermostat engages over the heating device for the purpose of temperature detection. The first and the third heating element are connected to an energy supply over the rod-type thermostat. A second heating element is connected to an energy supply without interconnection of the rod-type thermostat, wherein the second heating element is arranged on the support in the central region, in the intermediate region and in the outer region.

21 Claims, 3 Drawing Sheets

(51) Int. Cl.
*H05B 1/02* (2006.01)
*H05B 3/76* (2006.01)

(56) References Cited

U.S. PATENT DOCUMENTS

| | | | | | |
|---|---|---|---|---|---|
| 4,544,831 | A | | 10/1985 | Bayer | |
| 4,633,238 | A | | 12/1986 | Goessler et al. | |
| 5,153,413 | A | * | 10/1992 | Wilde | H05B 3/748 219/458.1 |
| 5,171,973 | A | | 12/1992 | Higgins | |
| 5,498,853 | A | | 3/1996 | Gross et al. | |
| 6,018,149 | A | * | 1/2000 | Higgins | H05B 1/0266 219/443.1 |
| 6,064,045 | A | | 5/2000 | Reichert et al. | |
| 7,053,340 | B2 | * | 5/2006 | Wilde | H05B 3/746 219/446.1 |
| 8,420,984 | B2 | * | 4/2013 | Kaiser | H05B 3/746 219/448.12 |
| 2004/0182850 | A1 | | 9/2004 | Wilde et al. | |

FOREIGN PATENT DOCUMENTS

| | | | |
|---|---|---|---|
| EP | 1392081 | A2 | 2/2004 |
| EP | 1448024 | A2 | 8/2004 |

* cited by examiner

HEATING DEVICE AND METHOD FOR OPERATING A HEATING DEVICE

CROSS-REFERENCE TO RELATED APPLICATIONS

This application claims priority to German Application No. DE 10 2013 216 290.1, filed Aug. 16, 2013, the contents of which are hereby incorporated herein in its entirety by reference.

TECHNOLOGICAL FIELD

The invention relates to a heating device and to a method for operating a heating device.

BACKGROUND

U.S. Pat. No. 7,053,340 B2 discloses, in the case of a heating device which has a plurality of independent and separate long heating elements, dividing the heating elements into three heating elements. A first and a second heating element are connected to an energy supply means by means of an overtemperature protection means in the form of a so-called rod-type thermostat. The overtemperature protection means switches off the two heating elements in the event of an overtemperature. An overtemperature of this kind may be approximately 500° C. to 600° C. and be considered a hazard to a hob plate which is composed of glass ceramic. A third heating element is connected to an energy supply means directly and without monitoring by the overtemperature protection means and without interconnection of the overtemperature protection means. In this case, the electrical power of the third heating element is considerably lower than that of the first and second heating elements.

BRIEF SUMMARY

The invention is based on the object of providing a heating device of the kind described in the introductory part and also providing a method for operating the heating device, with which heating device and method problems in the prior art can be solved and it is possible, in particular, to allow firstly an accelerated initial cooking mode and secondly a keep-warm mode in conjunction with a so-called energy controller.

This object is achieved by a heating device and also by a method. Advantageous and preferred refinements of the invention are the subject matter of the further claims and will be explained in greater detail in the text which follows. In the process, some of the features will be described only for the heating device or only for the method. However, irrespective of this, they are intended to be independently applicable both to the heating device and also to the method. The wording of the claims is incorporated in the description by express reference.

Provision is made for the heating device to be provided for a cooking point in a hob or for a cooking point of this kind to be formed by the heating device. The heating device has a plurality of independent and separate long or elongate heating elements, for example according to U.S. Pat. No. 5,498,853 A, which are arranged on a support of the heating device in loops and/or in a spiral manner and/or in a meandering manner and/or substantially along concentric circles. The support has at least one central region in the middle or around a centre point, and also an outer region which adjoins an outer edge. The width of the central region and the width of the outer region can be approximately equal, wherein the central region can preferably be somewhat wider, for example 10% to 30% or even up to 40% wider. The heating elements run on the support so as to engage one in the other and cover a significant area of the support. This is known from the abovementioned document U.S. Pat. No. 5,498,853 A.

An overtemperature protection means engages over the heating device or the support or the overtemperature protection means is located above the heating device or support. The overtemperature protection means can detect the temperature above the heating device or at least that a specific temperature has been reached, specifically the so-called overtemperature at the heating device. The overtemperature protection means can then act on the heating device such that the heating power of the heating device is reduced and the temperature falls again. At least a first heating element is connected to an energy supply means by means of this overtemperature protection means in order to switch off the first heating element in the event of an overtemperature. A second heating element, preferably solely the second heating element, is connected to an energy supply means without interconnection of the overtemperature protection means or another overtemperature protection means.

According to the invention, the second heating element is arranged on the support both in the central region and in the outer region, advantageously in a distributed manner in each case, wherein the heating element has at least one turn or circulates once in each of the two regions. Therefore, expressed in simple terms, the second heating element is provided in an outer region of the heating device and in an inner region of the heating device and not only on the outside or only on the inside. As a result, both an abovementioned keep-warm mode with a low power and also an additionally increased power in the initial cooking mode can be achieved more easily.

In an advantageous refinement of the invention, provision is made for the support to be circular in the case of two regions in which the second heating element runs. In this case, the central region lies in an inner radius range of up to 50% or 60% of the radius. The outer region adjoins the outside of the central region and therefore lies in an outer radius range over 40% or 50% of the radius. In this case, the second heating element runs in two regions, that is to say as it were on the inside and on the outside.

In an alternative refinement, an intermediate region is further provided between the central region and the outer region, the second heating element likewise running with at least one turn in the intermediate region. The width of the three regions can be approximately equal, wherein the width of the central region is advantageously larger. The support can be circular in this case too, wherein the central region lies in an inner radius range of up to 40% to 50% or even up to 60% of the radius. The intermediate region adjoins the outside of the central region in an intermediate radius range of 40% or 50% to 70% or 80% of the radius. The outer region again adjoins the outside of the intermediate region and lies in an outer radius range over 70% or 80% of the radius.

In a modification of the invention, the supports may not be circular in the two abovementioned alternatives, but rather elongate and oval or approximately rectangular. The information relating to the widths or the radii of the two or three regions is equivalent in this case, wherein the percentages in that case do not relate to the radius of a circular shape, but rather relate to the narrowest half width of the entire heating device.

In an advantageous refinement, the majority of the support is covered by heating elements. At least 10% or 20% of the radius up to 100% of the radius, in particular up to a maximum of 95%, of the support is advantageously covered by at least one heating element. A distance between the heating elements or between two turns of the heating elements which run next to one another can lie in the region of a few mm, for example 2 mm to 5 mm or even 8 mm. This distance is advantageously substantially equal for the entire heating device.

Provision may be made for an outermost turn of the heating device to not be formed by the second heating element, but rather, for example, by the first heating element or a third heating element. Provision may further be made for a second-outermost turn of all of the heating elements or of the heating device to be formed by the second heating element. Therefore, it is also the outermost turn of the second heating element.

Provision may be made for, at most, a third-innermost turn of the heating elements or of the heating device to be formed by the second heating element as the innermost turn of the heating element. It is initially advantageously a fourth-innermost turn, so that no turn of the second heating element, but rather advantageously only of the first heating element, is provided around a centre of the heating device.

In an advantageous refinement of the invention, provision is made for the second heating element to be arranged on the support substantially in duplicate and parallel next to another in so-called double turns. At least one turn, preferably at least one double turn, of another heating element or of the first heating element is provided between two double turns of the second heating element, in particular between the two outermost double turns of the second heating element. This results in no two double turns of the second heating element running directly next to one another because otherwise too great an annular region of the heating device or on the support would be covered only by the second heating element and this could mean an undesirably high power concentration without overtemperature protection. The second heating element is advantageously arranged only in double turns on the support. This may also apply to further heating elements. Two or four turns of another heating element, which may be the first heating element but under certain circumstances may also be a third heating element, particularly advantageously always run between two double turns of the second heating element.

The heating device can be in the form of a twin-ring heating device and have three heating elements, wherein the three abovementioned regions are then also advantageously provided as central region, intermediate region and outer region. A first heating element can be provided primarily in the central region and not in the outer region. A third heating element can be provided primarily in the outer region and advantageously not in the central region. A second heating element runs in all three regions just as described above.

In an advantageous refinement of the invention, the overtemperature protection means is a so-called rod-type thermostat with an elongate thermomechanical expansion element. Rod-type thermostats of this kind are known, for example, from U.S. Pat. No. 4,633,238 A or U.S. Pat. No. 4,544,831 A. At a specific temperature, a switch is tripped by the thermomechanical expansion element and therefore the first heating element, under certain circumstances also the abovementioned third heating element, is switched off.

Provision can be made for the power of the second heating element to be at most 1200 watts, preferably 1000 watts, at a mains voltage of 230 volts. The power per unit area of the second heating element may advantageously lie below 2.5 W/cm2.

Therefore, according to the invention, the second heating element is operated without interconnection of the overtemperature protection means and also without monitoring by the overtemperature protection means. In a keep-warm mode of the cooking point or of the heating device, the second heating element can be operated on its own, without the overtemperature protection means. In a normal cooking mode, the second heating element can be connected as required, but does not have to be. In an initial cooking mode, all of the heating elements of the heating device are operated, in particular in a twin-ring heater in the twin-ring mode. In this case, the second heating element has the advantage for a particularly high initial cooking power that, at an excessive temperature, the overtemperature protection means for protecting a glass-ceramic hob plate responds and switches off a first and possibly a third heating element for safety reasons. However, in order that the electrical power does not fall to zero directly after this, but at the same time a relatively low power cannot be generated by the switched-off heating elements without changing the power stage set by an operator, the second heating element can continue to be operated. The power per unit area of the second heating element is relatively low on account of the large distribution, wherein it is advantageously less than 2.5 W/cm2. If the temperature beneath the hob plate has then again fallen so far that the overtemperature protection means again enables or again switches on the first and the third heating element, the first and third heating elements can again operate additionally and at a very high total power.

These and further features are apparent not only from the claims but also from the description and the drawings, where the individual features can in each case be realized on their own or jointly in the form of subcombinations in an embodiment of the invention and in other fields and can constitute advantageous and inherently protectable embodiments for which protection is claimed here. The subdivision of the application into subheadings and individual sections does not restrict the general validity of the statements made thereunder.

BRIEF DESCRIPTION OF THE SEVERAL VIEWS OF THE DRAWINGS

Exemplary embodiments of the invention are schematically illustrated in the drawings and will be explained in greater detail in the text which follows. In the drawings.

DETAILED DESCRIPTION

Figure 1:
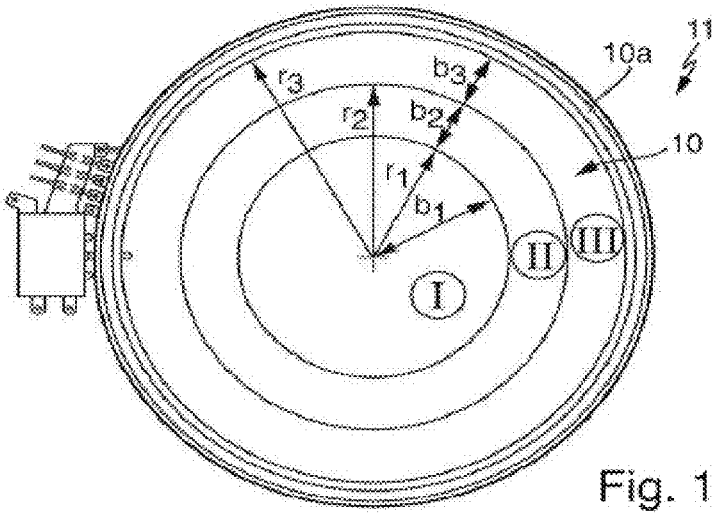
FIG. 1 is a schematic illustration of a support for a heating device according to the invention divided into three radius ranges.
Figure 2:
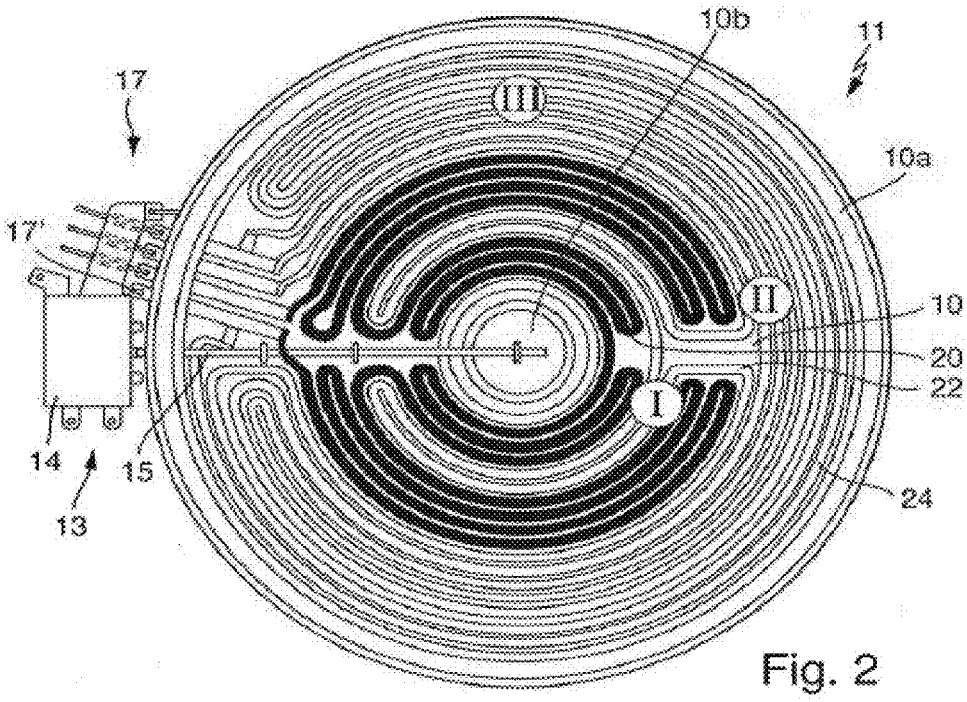
FIG. 2 shows a heating device with the support from FIG. 1 and covered by three heating elements, wherein only an innermost heating element is active.

FIG. 1 shows a support 10 for an electrical heating device 11 according to FIG. 2, which support is of circular design and has a peripheral support edge 10*a* and a central raised support portion 10*b* which is illustrated centrally in FIG. 2. The flat area of the support 10 within the support edge 10*a* is divided into three radius ranges, specifically a central region I, an intermediate region II and an outer region III. The central region I has a radius $r_1$ and a width $b_1$. The intermediate region II extends with a width $b_2$ between the radii $r_1$ and $r_2$. The outer region III extends with a width of $b_3$ between the radii of $r_2$ and $r_3$. It can be seen that the radius $r_1$ takes up almost 50% of the total radius of the support 10 or within the support edge 10*a*. The radius $r_2$ takes up approximately 75% and the radius $r_3$ takes up almost 100% within the support edge 10*a*. The width $b_1$ of the central region I is therefore somewhat greater than that of the other regions II and III, wherein the area requirement for the raised support portion 10*b* is to be taken into consideration.

FIG. 2 shows how a rod-type thermostat 13 with a switching housing 14 and a long sensor 15 is arranged on the support 10 or on the heating device 11. In this case, the elongate straight sensor 15 extends as far as the raised support portion 10*b* and there is fitted to the raised support portion in a manner which is known per se, and possibly fastened by means of a clip. A connection region 17 is provided next to the rod-type thermostat 13 or its switching housing 14, the connection region having a plurality of connection lugs or plug connections as an electrical contact-making means to the heating elements.

The heating elements of the heating device 11 run on the support 10. A first heating element 20, which runs in the inner of the two regions I and II and in particular also forms the three innermost turns in the central region I, is illustrated shaded black. The first heating element is connected to a connection lug 17' which is connected to the rod-type thermostat 13 or the rod-type thermostat 13 is looped into the energy supply means of the connection lug. The first heating element is also switched on.

A second heating element 22 runs in three double turns. The innermost double turn runs in the central region I, specifically as it were embedded centrally into the first heating element 20. The middle double turn runs in the intermediate region II so as to radially adjoin the outside of the first heating element 20. The third and outermost double turn of the second heating element 22 runs in the outer region III relatively far on the outside of the support 10. Only an individual turn of a third heating element 24 is further provided radially outside the outer region, the third heating element running in the outer region III and in the transition to the intermediate region II. The third heating element 24 has only one double turn and the outermost individual turn in this case. As described above for the first heating element 20, the third heating element 24 is also connected to an energy supply means by means of the connection lug 17' with a looped-in rod-type thermostat 13 as the overtemperature protection means.

In the connection region 17, it can be seen that the three heating elements 20, 22 and 24 can each be switched on or driven separately. The electrical connections to the second heating element 22 pass by the rod-type thermostat 13 or the corresponding connection lug 17'.

The transition between the three regions I, II and III is once again illustrated along the profile of the sensor 15 by the encircled vertical bars.

Only the first heating element 20 is in operation here in FIG. 2. Since the entire heating device 11 is in the form of a so-called twin-ring heating means, the first heating element 20 forms the first ring or the small diameter in the single-ring mode, wherein the diameter can in this case be considered to be an approximately 140 mm cooking point. During operation as a single ring according to FIG. 2, the heating power of the first heating element 20 is approximately 1200 watts at 230 volts. The second heating element 22 and the third heating element 24 are switched off in this case.

Figure 3:
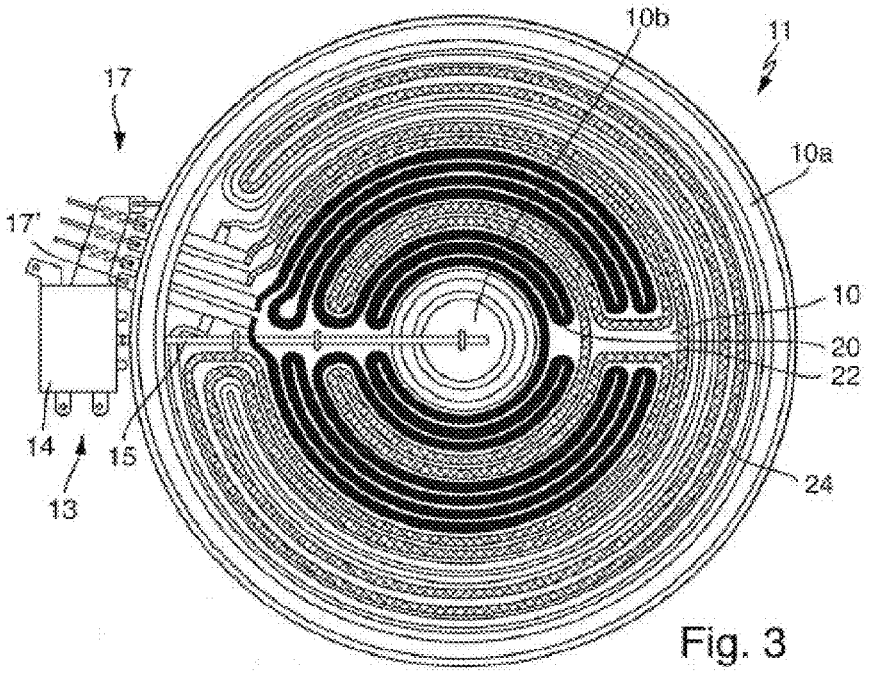
FIG. 3 shows the heating device from FIG. 2 in another operating state with all three heating elements activated.

The illustration of FIG. 2 is repeated in FIG. 3. In FIG. 3, the second heating element 22 is illustrated shaded with wavy lines and the third heating element 24 is not marked, in order to distinguish between them. All three heating elements 20, 22 and 24 are in operation in FIG. 3. The diameter is approximately 230 mm in this twin-ring mode. In this case, the total electrical power is 3200 watts at a supply voltage of 230 volts; therefore all three heating elements are connected in parallel. The second heating element 22 and the third heating element 24 have a heating power of in each case approximately 1000 watts.

With the known function of the rod-type thermostat 13, it is apparent that the first heating element 20 and the third heating element 24 are switched off by the rod-type thermostat 13 in the event of an overtemperature. However, the second heating element 22 can be operated at a relatively high power without an overtemperature protection means of this kind or permanently operated on account of the widely-spaced or separated distribution. Therefore, the generation of power can be increased overall in a desired mode with a very high power or high initial cooking power as initial cooking mode. Furthermore, a low permanent power, which may be available in the twin-ring mode with a large pot, could theoretically also be achieved per se on account of the relatively low power of the second heating element which, in relation to the area which is heated by it overall, is less than the abovementioned 2.5 $W/cm^2$. The second heating element would advantageously have to be electronically driven for this purpose.

Furthermore, as an alternative, the unprotected power of the second heating element 22 can be switched off, in particular when even the initial cooking mode is not in operation, and a power of at most 2200 watts remains. Given a minimum power release by means of a power actuator or energy controller, for example in accordance with DE 102008014805 A1 or U.S. RE 31596 E, of 6%, 132 watts are produced as the total power. Although this is relatively low, it may be sufficient for a keep-warm mode on the cooking point in the twin-ring mode with the full area.

Figure 5:
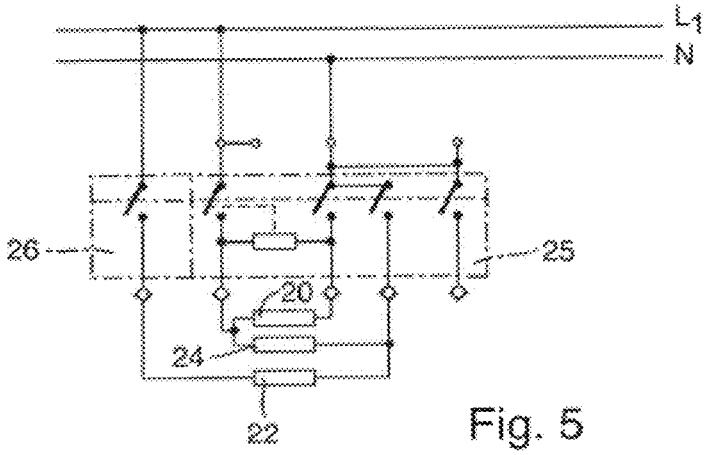
FIG. 5 is an illustration of a circuit diagram for driving with a setting switch for the heating device from FIG. 3.

FIG. 5 shows a circuit diagram for the heating device 11 according to the invention together with the conventional energy controller as power control device 25, as is known and primarily can be realized with a power control device according to US RE 31596 E together with additional switches or setting switch 26. The power control device uses the so-called relative switch-on period ED according to U.S. Pat. No. 6,064,045 A to control the on and off times of the heating elements or the timing ratio for the energy supply. A setting switch 26 is illustrated using dashed lines, the setting switch being additionally mounted on a power control device 25 which is illustrated using dashed-and-dotted lines and being co-rotated by the same rotary shaft. In addition to setting the power by means of the power control device 25, the setting switch 26 can connect or disconnect the second heating element 22, which is illustrated at the bottom, to or from the power control device.

Figure 6:
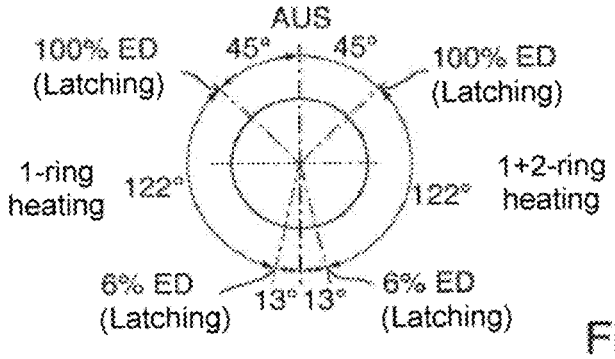
FIG. 6 shows a schematically illustrated energy controller with description of its rotation angle regions.

FIG. 6 shows the setting options for the heating device 11 according to the invention in line with the method according to the invention. From the zero position at 0° or at OFF, it is possible to turn anticlockwise to the left, this leading to the so-called single-ring mode. In this case, only the first heating element 20 is operated and therefore the single-ring mode is largely of no interest in terms of the invention.

Turning from the zero position at 0° at OFF to the right in the clockwise direction leads to the twin-ring mode with the heating elements 20 and 24. At 45°, latching is provided with a latching position which corresponds to a maximum power. In this case, a value for ED of 100% is provided for the heating elements 20 and 24, and the second heating element 22 is also connected by means of the setting switch 26. Accordingly, the heating elements 20 and 24 are actually permanently switched on as standard, and only the overtemperature protection means switches off the heating elements by means of the rod-type thermostat 13 when the switching point of the rod-type thermostat is reached. However, the second heating element 22 continues to operate in this case, as explained above.

Further rotation to the right reduces the value for ED until it reaches the lowest value, specifically ED=6%, at an angle of approximately 167°, wherein this position can be defined by latching and/or a stop. Furthermore, the second heating element 22 is switched off by means of the setting switch 26 starting from an angle of greater than 45°, and therefore the heating element can be operated only at the maximum power. At the position of 167°, a low power of 132 watts, which is advantageous for an abovementioned keep-warm mode, is available at 6% of the power of the heating elements 20 and 24 which together produce 2200 watts.

Figure 4:
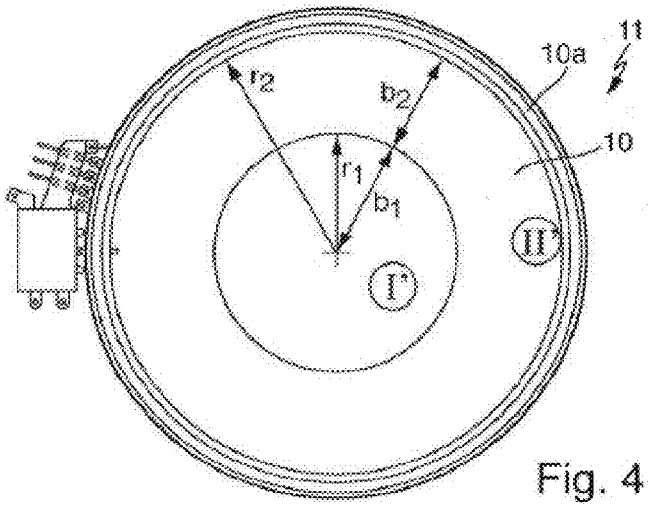
FIG. 4 shows a modification of the support from FIG. 1 divided into two radius ranges.

FIG. 4 shows, as a modification of the illustration from FIG. 1, a heating device 111 according to the invention with a support 110, wherein the area of the support 110 is divided only into a central region I' and an outer region II'. The central region I' extends up to a radius of $r_1$ and has a width of $b_1$. The outer region II' extends from the radius $r_1$ up to a radius $r_2$ and has a width of $b_2$. In this case, the statements made at the outset correspondingly apply; the second heating element 22 of FIG. 2 and FIG. 3 could run in the central region I' and in the outer region II'. A first heating element and, where possible, also a third heating element could be divided between the central region I' and the outer region II'.

That which is claimed:

1. A heating device for a cooking point in a hob, wherein said heating device comprises:

a plurality of independent and separate long heating elements which are arranged on a support of said heating device in loops or in a spiral manner or substantially along concentric circles, wherein said support has at least a central region around a center point and an outer region adjoining an outer edge, wherein a width of said central region and of said outer region is approximately equal, wherein said heating elements run on said support so as to engage one in the other and cover a significant area of said support, wherein an overtemperature protection means engages over said heating device or said support for purpose of detecting a temperature at said heating device, wherein at least a first heating element is connected to an energy supply means by means of said overtemperature protection means in order to switch off said first heating element in an event of an overtemperature, wherein a second heating element is connected to an energy supply means without interconnection of said overtemperature protection means or another overtemperature protection means, wherein said second heating element is arranged on said support in said central region of said support and in said outer region adjoining said outer edge of said support, and wherein said second heating element is arranged on said support substantially in duplicate parallel next to another heating element in double turns, wherein at least one turn of said first heating element is provided between two double turns of said second heating element.

2. The heating device according to claim 1, wherein said support is circular, and said central region lies in an inner radius range of up to 60% of said radius, and said outer region lies in an outer radius range of over 60% of said radius.

3. The heating device according to claim 1, wherein an intermediate region is provided between said central region and said outer region, wherein a width of said central region, of said intermediate region and of said outer region is approximately equal, and wherein said second heating element also runs in said intermediate region.

4. The heating device according to claim 3, wherein said support is circular, and said central region lies in an inner radius range of up to 40% of said radius, said intermediate region lies in an intermediate radius range of 40% to 70% of said radius, and said outer region lies in an outer radius range of over 70% of said radius.

5. The heating device according to claim 1, wherein at least 10% of said radius up to a maximum of 95% of said radius of said support is covered by at least one said heating element.

6. The heating device according to claim 1, wherein a second-outermost turn of said heating elements is formed by said second heating element as said outermost turn of said second heating element.

7. The heating device according to claim 1, wherein, a third-innermost turn of said heating elements is formed by said second heating element.

8. The heating device according to claim 1, wherein, a fourth-innermost turn of said heating elements is formed by said second heating element.

9. The heating device according to claim 1, wherein said second heating element is arranged on said support substantially in duplicate parallel next to another heating element in double turns, wherein at least one turn of the another heating element is provided between two double turns of said second heating element.

10. The heating device according to claim 9, wherein at least one double turn of the another heating element or of said first heating element is provided between two double turns of said second heating element.

11. The heating device according to claim 9, wherein said at least one turn of the another heating element or of said first heating element is provided between said two outermost double turns of said second heating element.

12. The heating device according to claim 9, wherein said second heating element is arranged on said support only in double turns.

13. The heating device according to claim 12, wherein two or four turns of the another heating element or of said first heating element run between two double turns of said second heating element.

14. The heating device according to claim 1, wherein said overtemperature protection means is a rod-type thermostat with a thermomechanical expansion element and a switch which is tripped at a specific temperature of said thermomechanical expansion element.

15. The heating device according to claim 1, wherein a power of said second heating element is at most 1200 watts during operation at a mains voltage of 230 volts.

16. A method for operating a heating device according to claim 1, wherein said second heating element is operated without interconnection of said overtemperature protection means and without monitoring by said overtemperature protection means.

17. The method according to claim 16, wherein, in a keep-warm mode of said cooking point or of said heating device, said second heating element is operated on its own, without overtemperature protection.

18. The method according to claim 16, wherein, in a normal cooking mode, said second heating element and at least one further heating element or said first heating element are operated together.

19. The method according to claim 18, wherein said second heating element and at least one further heating element or said first heating element are operated together and connected in parallel with one another.

20. The method according to claim 16, wherein, in an initial cooking mode with a maximum power of said heating device, said second heating element and at least one further heating element or said first heating element are operated together in order to increase said power generated.

21. The method according to claim 20, wherein said second heating element and at least one further heating element or said first heating element are connected in parallel with one another.

* * * * *